US008943853B2

(12) United States Patent
Fujioka et al.

(10) Patent No.: US 8,943,853 B2
(45) Date of Patent: Feb. 3, 2015

(54) WASTE HEAT UTILIZING DEVICE FOR AIR COMPRESSOR

(75) Inventors: Tamotsu Fujioka, Yokohama (JP); Atsushi Unami, Yokohama (JP)

(73) Assignee: Anest Iwata Corporation, Kanagawa-Ken (JP)

( * ) Notice: Subject to any disclaimer, the term of this patent is extended or adjusted under 35 U.S.C. 154(b) by 135 days.

(21) Appl. No.: 13/587,156

(22) Filed: Aug. 16, 2012

(65) Prior Publication Data

US 2013/0067951 A1 Mar. 21, 2013

(30) Foreign Application Priority Data

Sep. 16, 2011 (JP) ..... 2011-203104

(51) Int. Cl.
*F25B 1/00* (2006.01)
*F01K 23/06* (2006.01)
*F25B 9/06* (2006.01)

(52) U.S. Cl.
CPC ..... *F25B 9/06* (2013.01)
USPC ..... 62/501; 60/670

(58) Field of Classification Search
USPC ..... 62/87, 98, 99, 116, 172, 238.4, 401, 62/501
See application file for complete search history.

(56) References Cited

U.S. PATENT DOCUMENTS 3,144,317 A * 8/1964 Arnoldi ..... 62/637
3,945,210 A * 3/1976 Chapin ..... 60/618
4,271,679 A * 6/1981 Schafer ..... 62/238.4
6,526,775 B1 * 3/2003 Asfia et al. ..... 62/402
6,804,975 B2 * 10/2004 Park ..... 62/324.1
6,962,056 B2 * 11/2005 Brasz et al. ..... 60/772
2004/0020206 A1 * 2/2004 Sullivan et al. ..... 60/670
2007/0074515 A1 * 4/2007 Yoshino ..... 60/670
2008/0283294 A1 * 11/2008 Colquhoun ..... 175/25

FOREIGN PATENT DOCUMENTS

JP 2010-101184 A 5/2010
JP 2010-101184 A * 6/2010
JP 2010-270729 A 12/2010

OTHER PUBLICATIONS

Huang, F., "Oil-Free Screw Compressor or Oil-Injected Screw Compressor?" (2000), International Compressor Engineering Conference, Paper 1476. Http://docs.lib.purdue.edu/icec/1476.*
Sprague products. "Air Driven Hydraulic Pumps, Gas Boosters, Power Units, Specialty Valves and Accessories." (2005).*

* cited by examiner

*Primary Examiner* — Cassey D Bauer
*Assistant Examiner* — Steve Tanenbaum
(74) *Attorney, Agent, or Firm* — Lowe Hauptman & Ham, LLP

(57) ABSTRACT

A waste heat utilization device for an air compressor includes: a discharge path of an oil free air compressor; a circulation path along which a low boiling point medium circulates; an evaporator provided on the circulation path to heat and evaporate the low boiling point medium using the potential heat of the compressed air; and a preheater provided on an upstream side of the evaporator to preheat the low boiling point medium using the potential heat of the compressed air. A scroll type expansion machine is rotated by the low boiling point medium evaporated by the evaporator and increased in pressure, and power is generated by a power generator connected to a rotary shaft of the scroll type expansion machine. The low boiling point medium discharged from the scroll type expansion machine is then cooled and condensed by a condenser.

7 Claims, 4 Drawing Sheets

WASTE HEAT UTILIZING DEVICE FOR AIR COMPRESSOR

RELATED APPLICATIONS

The present application is based on, and claims priority from, Japanese Application Number 2011-203104, filed Sep. 16, 2011, the disclosure of which is hereby incorporated by reference herein in its entirety.

BACKGROUND OF THE INVENTION

1. Field of the Invention

The present invention relates to a waste heat utilization device for an air compressor that effectively utilizes potential heat of compressed air discharged from the air compressor in order to reduce a power consumption of the air compressor.

2. Description of the Related Art

Compressed air discharged from an air compressor reaches high temperatures of up to 200° C., for example, and therefore, as disclosed in Japanese Patent Application Publication No. 2010-101184, the compressed air is cooled by an aftercooler using cooling water and then cooled further by a refrigeration type dryer using a coolant, whereupon moisture contained in the compressed air is condensed and separated for use. An air compressor main body is thus prevented from overheating by water cooling, air cooling, or the like. An air compressor is one of the machines that consume the greatest amounts of power in a typical factory, and therefore takes up a large proportion of the entire power consumption of the factory. It is therefore desirable to reduce the power consumption of an air compressor.

In a configuration disclosed in Japanese Patent Application Publication No. 2010-101184, a reheater that reheats the compressed air using cooling water heated after cooling the compressed air in the aftercooler is provided on a downstream side of the refrigeration type dryer. By having the reheater reheat the compressed air that has been cooled excessively by the refrigeration type dryer such that a pressure of the compressed air increases again, a load on the air compressor is reduced, leading to a reduction in the power consumption of the air compressor. Japanese Patent Application Publication No. 2010-101184 also discloses a configuration in which cooling water containing thermal energy not consumed by the reheater is transmitted to a boiler facility for use.

In a configuration disclosed in Japanese Patent Application Publication No. 2010-270729, an exhaust heat boiler is provided to generate steam by performing heat exchange between compressed air discharged from an oil free air compressor and supply water so that the supply water evaporates. The heat of the compressed air is then recovered as steam energy.

In the power consumption reduction method disclosed in Japanese Patent Application Publication No. 2010-101184, the heat absorbed by the cooling water in a primary heat exchange between the compressed air and the cooling water in the aftercooler is returned to compressed air in a secondary heat exchange performed in the reheater, and therefore two heat exchange operations are performed. As a result, a heat recovery rate deteriorates. Further, in Japanese Patent Application Publication No. 2010-101184 and Japanese Patent Application Publication No. 2010-270729, potential heat of the compressed air is recovered as steam energy in the boiler, but recovering the potential heat of the compressed air as steam energy does not lead directly to a reduction in the power consumption of the air compressor.

SUMMARY OF THE INVENTION

The present invention has been designed in consideration of the problems in the related art, and an object thereof is to enable efficient recovery of the potential heat of compressed air discharged from an air compressor so that recovered thermal energy can be used to reduce a power consumption of the air compressor.

To solve the problems described above, a waste heat utilization device for an air compressor according to the present invention includes: an air compressor; a discharge path of the air compressor; a circulation path along which a low boiling point medium circulates; an evaporator interposed on the discharge path and the circulation path to evaporate the low boiling point medium by performing heat exchange between the low boiling point medium and compressed air discharged from the air compressor or lubricating oil included in the compressed air; an expansion machine into which the low boiling point medium evaporated by the evaporator is introduced such that a rotary force is applied thereto by the low boiling point medium; and a condenser that cools and condenses the low boiling point medium discharged from the expansion machine, wherein a power of the air compressor is reduced by the rotary force generated in the expansion machine.

In the device of the present invention, the low boiling point medium is evaporated by the potential heat of the compressed air discharged from the air compressor, and the expansion machine is operated using the evaporated low boiling point medium. As a result, the potential heat of the compressed air can be converted efficiently into rotary power for operating the expansion machine. Pentane, ammonia, or the like, for example, can be used as the low boiling point medium. Further, a scroll compressor, a screw compressor, a claw compressor, a reciprocating compressor, or the like, for example, can be used as the air compressor.

By connecting a power generator to an output shaft of the expansion machine rotated by the low boiling point medium, power can be generated, and using the generated power, the power consumption of the air compressor can be reduced. Alternatively, by connecting the rotary shaft of the expansion machine to an output shaft of a drive motor of the air compressor, a rotary torque of the air compressor can be reduced, and as a result, the power consumption of the air compressor can be reduced.

When the air compressor is an oil free air compressor, the compressed air discharged from the air compressor is used as a heat source such that the low boiling point medium is evaporated by the potential heat of the compressed air. When the air compressor is a compressor that uses oil, compression heat is held, and the low boiling point medium is evaporated by the potential heat of lubricating oil separated from the compressed air in an oil separator.

In the device of the present invention, when the air compressor is an oil free air compressor, high-temperature compressed air not cooled by lubricating oil can be introduced into the evaporator. Accordingly, an amount of heat supplied to the low boiling point medium can be increased, enabling an increase in the amount of power that can be recovered by the expansion machine. When the air compressor is an oil type air compressor, the compressed air is cooled by the lubricating oil, and therefore the temperature of the compressed air does not increase as in the oil free type. Even so, the lubricating oil reaches a temperature of approximately 100° C., and the low boiling point medium can be evaporated sufficiently at this temperature. Hence, power can be recovered by the expansion machine, enabling a reduction in the power consumption of the air compressor.

The device of the present invention preferably further includes a preheater that is interposed on the discharge path and the low boiling point medium circulation path of the air compressor in order to preheat the low boiling point medium prior to being subjected to the heat exchange in the evaporator, using the compressed air following the heat exchange in the evaporator or the lubricating oil included in the compressed air. By providing the preheater, a load on the evaporator can be lightened, and the low boiling point medium can be heated by the compressed air in stages, enabling an improvement in a heat exchange efficiency between the compressed air and the low boiling point medium.

The device of the present invention preferably further includes: a circulation pump interposed on the low boiling point medium circulation path to circulate the low boiling point medium; and a branch passage that bifurcates from the discharge path of the air compressor and is connected to the circulation pump, wherein the compressed air is introduced into the circulation pump from the branch passage such that the circulation pump is driven by the compressed air. Hence, a part of the compressed air can be used to drive the circulation pump, making power for driving the circulation pump unnecessary, and as a result, the power consumption can be reduced correspondingly.

The device of the present invention preferably further includes: an aftercooler interposed on the discharge path of the air compressor; and a cooling medium introduction passage that introduces a cooling medium from the aftercooler into the condenser, wherein the low boiling point medium is cooled in the condenser by the cooling medium. The aftercooler may be a refrigeration type dryer such as that disclosed in Japanese Patent Application Publication No. 2010-101184. The refrigeration type dryer cools a coolant using a refrigeration device that forms a refrigeration cycle, and cools the compressed air using the coolant. In this case, the cooling medium introduced into the condenser may be the aforesaid coolant, brine cooled through heat exchange with the coolant, or cooling water, outside air, or the like cooled through heat exchange with the coolant or the brine.

Preferably in the device of the present invention, constituent devices are housed in a single housing, the housing is provided with an outside air introduction port and an outside air discharge port, the condenser includes an outside air flow forming device and a heat exchanger that cools the low boiling point medium using an outside air flow, and outside air is introduced through the outside air introduction port by the outside air flow forming device, whereby the outside air flow forming device forms an outside air flow that passes through the heat exchanger inside the housing so as to cool the low boiling point medium and is then discharged from the outside air discharge port. The outside air flow forming device is an air blower, a fan, or the like, for example, which is capable of cooling the low boiling point medium in the condenser using the outside air flow formed in the housing and also cooling and ventilating the constituent devices, including the air compressor. As a result, the need to provide a separate cooling device is eliminated.

According to the device of the present invention, the condenser interposed on the discharge path and the low boiling point medium circulation path of the air compressor performs heat exchange between the low boiling point medium and the compressed air discharged from the air compressor or the lubricating oil included in the compressed air such that the low boiling point medium evaporates, whereupon the evaporated low boiling point medium is introduced into the expansion machine so as to operate the expansion machine. As a result, the potential heat of the compressed air discharged from the air compressor can be recovered efficiently as power for operating the expansion machine, and this recovered power enables a reduction in the power consumption of the air compressor.

DESCRIPTION OF THE PREFERRED EMBODIMENTS

Figure 1:
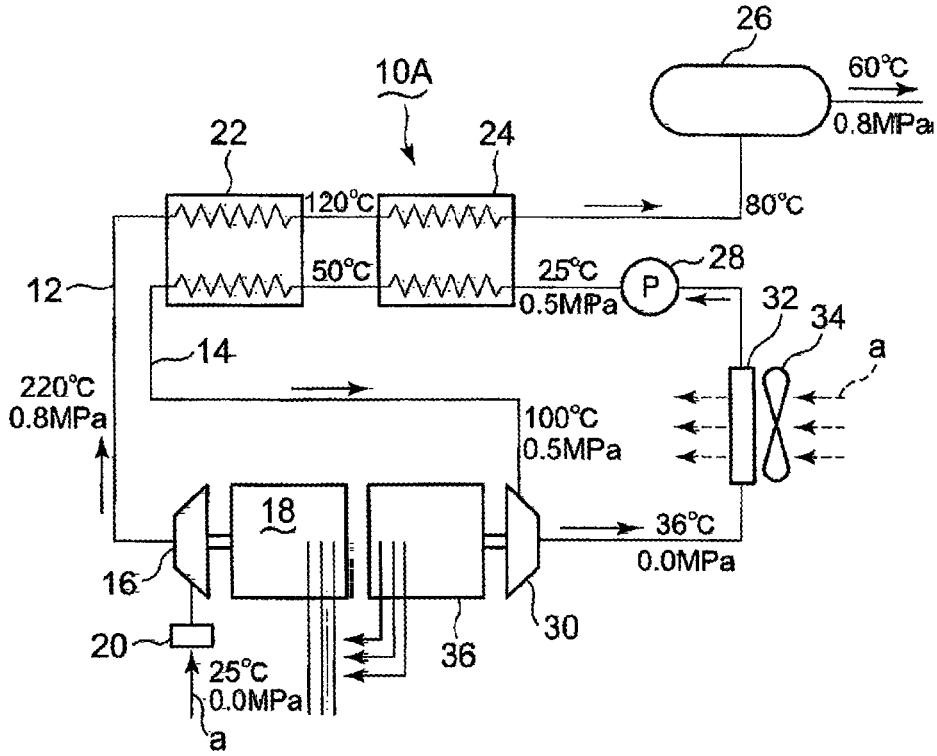
FIG. 1 is a system diagram of a waste heat utilization device according to a first embodiment of a device of the present invention.

The present invention will be described in detail below using embodiments illustrated in the drawings. Note, however, that unless specific description is provided to the contrary, dimensions, materials, shapes, relative arrangements, and so on of constituent components described in the embodiments are not intended to limit the scope of the present invention.

(First Embodiment)

A first embodiment in which the device of the present invention is applied to an oil free air compressor will be described below using FIG. 1. A waste heat utilization device 10A according to the embodiment shown in FIG. 1 is constituted by a discharge path 12 of the compressor, a low boiling point medium circulation path 14, and devices interposed on these paths. An oil free air compressor 16 is driven by a drive motor 18, and when the oil free air compressor 16 is driven, outside air a is suctioned through an air filter 20. Compressed air discharged from the oil free air compressor 16 is held temporarily in an air receiver 26 after passing through an evaporator 22 and a preheater 24, and is then supplied to a required destination.

The circulation path 14, meanwhile, is connected to the evaporator 22 and the preheater 24, and a circulation pump 28, a scroll type expansion machine 30, and a condenser 32 are interposed thereon. The low boiling point medium is circulated along the circulation path 14 in the direction of an arrow by the circulation pump 28. The condenser 32 is constituted by a heat exchanger that performs heat exchange between an outside air flow and the low boiling point medium. A fan 34 is annexed to the condenser 32, and an outside air flow a0 is formed by the fan 34. The low boiling point medium flowing through the condenser 32 is cooled and condensed by the outside air flow a0. A power generator 36 is connected to a rotary shaft of the scroll type expansion machine 30 such that when the scroll type expansion machine 30 rotates, power is generated.

A scroll compressor, a screw compressor, a claw compressor, a reciprocating compressor, or the like, for example, is used as the oil free air compressor 16. A medium such as pentane or ammonia, for example, is used as the low boiling point medium. To facilitate understanding of the waste heat utilization device 10A, temperature values and pressure values of the compressed air and the low boiling point medium are noted as examples in respective regions of the drawing. The pressure values are all gauge pressures.

In this configuration, the low boiling point medium exchanges heat in the evaporator 22 with high-temperature, high-pressure compressed air discharged from the oil free air compressor 16. As a result, the low boiling point medium is heated and evaporated. Before this, however, the low boiling point medium is preheated in the preheater 24 by compressed air discharged from the evaporator 22. By heating the low boiling point medium in two stages in this manner, a load on the evaporator 22 is lightened and a heat exchange efficiency is improved. The low boiling point medium, having been increased in pressure by being evaporated, is introduced into the scroll type expansion machine 30 and reduced in pressure while rotating the expansion machine 30. When the scroll type expansion machine 30 rotates, power is generated by the power generator 36. The low boiling point medium that flows out of the scroll type expansion machine 30 at atmospheric pressure is cooled and condensed by the outside air flow a0 in the condenser 32. The condensed low boiling point medium is reintroduced into the preheater 24 by the circulation pump 28.

According to this embodiment, the low boiling point medium is evaporated by the potential heat of the compressed air discharged from the oil free air compressor 16, whereupon the low boiling point medium, having been increased in pressure by being evaporated, rotates the scroll type expansion machine 30 such that power is generated. As a result, the potential heat of the compressed air can be converted efficiently into rotary power for operating the scroll type expansion machine 30. Further, since power can be generated by the power generator 36, a power consumption of the oil free air compressor 16 can be reduced. Moreover, using the oil free air compressor 16, high-temperature compressed air that is not cooled by lubricating oil can be generated. The low boiling point medium is heated by this compressed air, and therefore an amount of heat exchange between the compressed air and the low boiling point medium can be increased, enabling an increase in an amount of evaporation occurring in the low boiling point medium. Accordingly, a rotation speed of the scroll type expansion machine 30 can be increased, enabling an increase in an amount of generated power.

Further, the low boiling point medium is heated in two stages by the preheater 24 and the evaporator 22, and therefore the load on the evaporator 22 can be lightened and the heat exchange efficiency between the compressed air and the low boiling point medium can be improved.

(Second Embodiment)

Next, a second embodiment of the device of the present invention will be described using FIG. 2. In a waste heat utilization device 10B according to this embodiment, the oil free air compressor 16 and the scroll type expansion machine 30 are connected to a single output shaft 18*a* of the drive motor 18. All other configurations are identical to the first embodiment. In this embodiment, a rotary torque of the oil free air compressor 16 can be reduced by rotating the scroll type expansion machine 30 using the low boiling point medium.

According to this embodiment, the power consumption of the oil free air compressor 16 can be reduced by reducing the rotary torque of the oil free air compressor 16. Further, using the oil free air compressor 16, the amount of evaporation occurring in the low boiling point medium can be increased, enabling an increase in the rotation speed of the scroll type expansion machine 30, and therefore an amount by which the rotary torque of the oil free air compressor 16 is reduced can be increased.

(Third Embodiment)

Next, a third embodiment of the device of the present invention will be described using FIG. 3. In a waste heat utilization device 10C according to this embodiment, a branch passage 38 is provided on a discharge path 12*a* on a downstream side of the preheater 24, and the branch passage 38 is connected to the circulation pump 28. A part of the compressed air is introduced into the circulation pump 28 from the branch passage 38 and used as driving force for the circulation pump 28. Used compressed air c is then discharged through a discharge passage 40 provided in the circulation pump 28. All other configurations are identical to the first embodiment.

According to this embodiment, a part of the compressed air is introduced into the circulation pump 28 and used as driving force for the circulation pump 28, and therefore power for driving the circulation pump 28 is not required.

(Fourth Embodiment)

Next, a fourth embodiment of the device of the present invention will be described using FIG. 4. In a waste heat utilization device 10D according to this embodiment, a refrigeration type dryer 42 is provided on the discharge path 12*a* on the downstream side of the preheater 24 and an upstream side of the air receiver 26. A circulation path 44 for coolant or brine cooled by the refrigeration type dryer 42 is disposed between the refrigeration type dryer 42 and the condenser 32. The condenser 32 is structured as a heat exchanger that performs heat exchange between the coolant or brine flowing in from the circulation path 44 and the low boiling point medium. All other configurations are identical to the third embodiment.

In this configuration, low-temperature coolant, brine cooled by heat exchange with the coolant, or cooling water or outside air cooled by heat exchange with the coolant or brine is introduced into the condenser 32 from the refrigeration type dryer 42 along the circulation path 44. In the condenser 32, the low boiling point medium is cooled and condensed by this cooling medium. After cooling the low boiling point medium, the cooling medium is returned to the refrigeration type dryer 42 along the circulation path 44, and cooled again. According to this embodiment, the cooling medium is transmitted from the refrigeration type dryer 42 to the condenser 32, and as a result, a cooling effect on the low boiling point medium can be improved.

Figure 5:
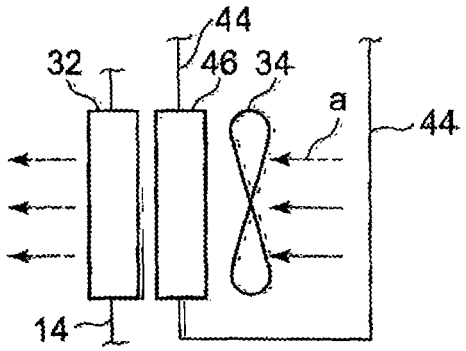
FIG. 5 is a system diagram showing a modified example of the fourth embodiment.

Next, a modified example of the fourth embodiment will be described using FIG. 5. Apart from configurations in illustrated sites, this modified example is configured identically to the fourth embodiment. The condenser 32 according to this modified example is configured similarly to that of the first embodiment. More specifically, the fan 34 for introducing the outside air a is annexed to the condenser 32 such that the condenser 32 forms a heat exchanger that performs heat exchange between the outside air flow a and the low boiling point medium. Further, a heat exchanger 46 is disposed between the condenser 32 and the fan 34. The cooling medium circulation path 44 is provided between the refrigeration type dryer 42 and the heat exchanger 46, and a similar cooling medium to that of the fourth embodiment is supplied to the heat exchanger 46.

In this configuration, the outside air a is introduced into the heat exchanger 46 and the condenser 32 by the fan 34. The heat exchanger 46 cools the outside air a using the cooling medium, whereupon the cooled outside air a cools the low boiling point medium flowing through the condenser 32. By additionally providing the heat exchanger 46, a temperature of the outside air a flowing through the condenser 32 can be lowered in advance, and as a result, the cooling effect on the low boiling point medium can be improved.

(Fifth Embodiment)

Next, a fifth embodiment of the device of the present invention will be described using FIG. 6. A waste heat utilization device 10E according to this embodiment forms a compressor unit in which the oil free air compressor 16 and the drive motor 18, the discharge path 12*a* on the upstream side of the refrigeration type dryer 42, and the circulation path 44, evaporator 22, preheater 24, condenser 32, and heat exchanger 46 constituting the waste heat utilization device are housed in an interior of a single housing 48. An outside air introduction port 48*a* is provided in the housing 48 in a side wall near the condenser, and an outside air discharge port 48*b* is provided on an opposite side to the outside air introduction port 48*a* in a side wall near the oil free air compressor. The fan 34 is disposed to face the outside air introduction port 48*a*. All other configurations are identical to the modified example (FIG. 5) of the fourth embodiment.

In this configuration, the outside air a is introduced through the outside air introduction port 48*a* by the fan 34. The outside air a is cooled by the heat exchanger 46, whereupon the cooled outside air a cools and condenses the low boiling point medium in the condenser 32. The outside air a introduced through the outside air introduction port 48*a* forms an outside air flow a0 in the interior of the housing 48. The outside air flow a0 cools the respective devices in the housing 48, starting with the oil free air compressor 16, and then flows out through the outside air discharge port 48*b*.

Hence, according to this embodiment, the low boiling point medium is cooled and condensed by the outside air a introduced into the housing 48 and cooled by the heat exchanger 46, while the interior of the housing 48 is ventilated by the outside air flow a0 formed in the housing 48. Furthermore, the devices in the housing 48, in particular the high-temperature oil free air compressor 16, can be cooled by the outside air flow a0, and therefore a specialized cooling device need not be provided separately.

(Sixth Embodiment)

Figure 7:
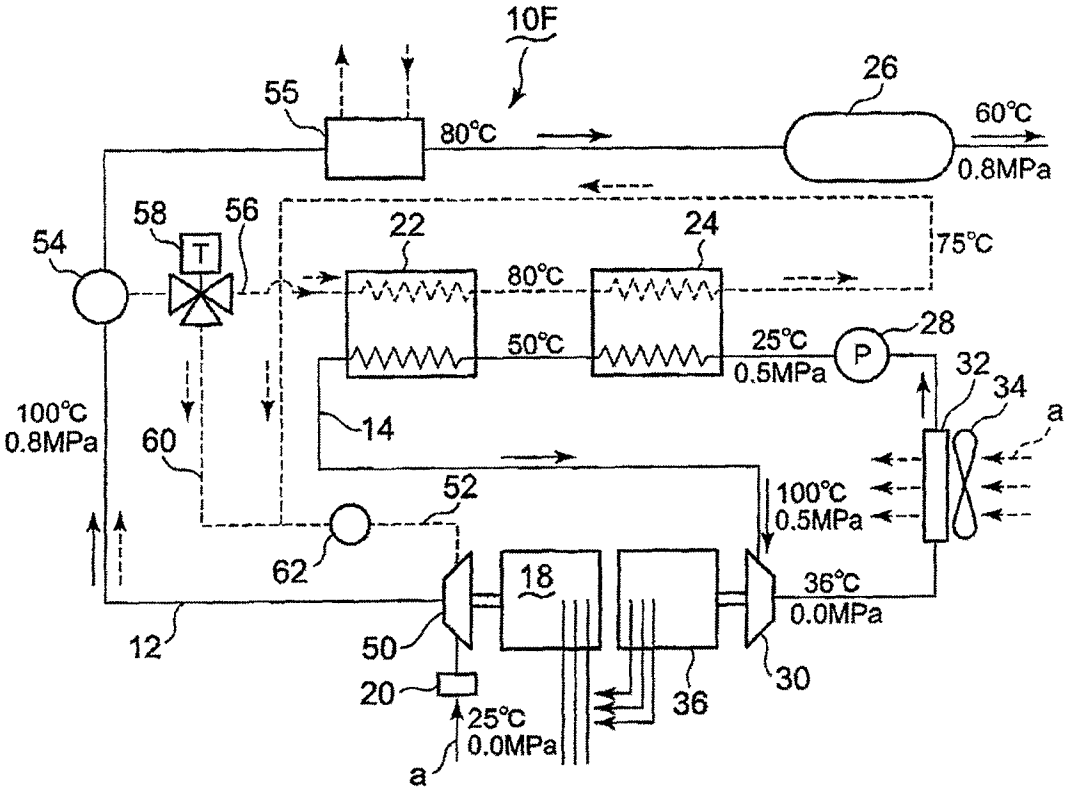
FIG. 7 is a system diagram of a waste heat utilization device according to a sixth embodiment of the device of the present invention.

Next, a sixth embodiment in which the present invention is applied to an oil type air compressor will be described using FIG. 7. In a waste heat utilization device 1OF according to this embodiment, lubricating oil is supplied to an oil type air compressor 50 along an oil path 52. Compressed air including the lubricating oil is discharged to the discharge path 12. Since the compressed air includes the lubricating oil, which exhibits a cooling action, the temperature of the compressed air is lower than that of the oil free air compressor. An oil separator 54 is provided on the discharge path 12. After separating the lubricating oil from the compressed air in the oil separator 54, the compressed air is cooled by an aftercooler 55 using cooling water or the like. The cooled compressed air is held temporarily in the air receiver 26 and then supplied to a required destination.

The lubricating oil separated from the compressed air is transmitted to the evaporator 22 along an oil path 56 and used to heat and evaporate the low boiling point medium in the evaporator 22. A temperature adjusting three-way valve 58 is interposed on the oil path 56 on an upstream side of the evaporator 22. A part of the lubricating oil is diverted to an oil path 60 by the three-way valve 58. Thus, an amount of lubricating oil introduced into the evaporator 22 can be adjusted, and as a result, a low-temperature operation is prevented from being performed in the evaporator 22, thereby preventing emulsification of the lubricating oil. The low boiling point medium is preheated by the lubricating oil in the preheater 24. The oil path 56 and the oil path 60 converge with the oil path 52 on a downstream side of the preheater 24. An oil filter 62 is interposed on the oil path 52, and contaminants and the like in the lubricating oil that flows onto the oil path 52 along the oil paths 56 and 60 are removed by the oil filter 62. The lubricating oil then flows into the oil type air compressor 50. All other configurations are identical to the first embodiment.

According to this embodiment, by introducing the lubricating oil, which contains a large amount of heat after cooling the compressed air, into the evaporator 22 and the preheater 24, the lubricating oil can be used to evaporate the low boiling point medium so that the low boiling point medium can be introduced into the scroll type expansion machine 30 at a high pressure. The low boiling point medium can then be used to rotate the scroll type expansion machine 30 such that power is generated by the power generator 36. Hence, likewise in an oil type air compressor, the potential heat of the compressed air can be used to reduce the power consumption of the air compressor.

Figure 2:
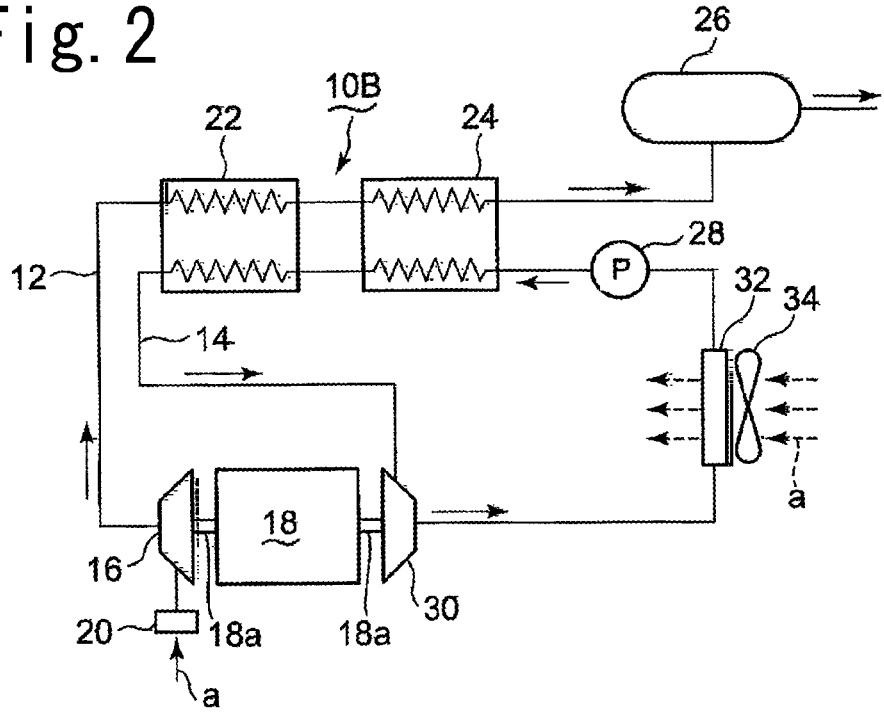
FIG. 2 is a system diagram of a waste heat utilization device according to a second embodiment of the device of the present invention.

When an oil type air compressor is used, the expansion machine 30 may be connected to the output shaft 18*a* of the drive motor 18 of the oil type air compressor, and a rotary torque of the oil type air compressor may be reduced by rotating the expansion machine 30 using the low boiling point medium, as in the second embodiment (FIG. 2). In this example, the power consumption of the oil type air compressor can be reduced by reducing the rotary torque of the oil type air compressor.

Figure 3:
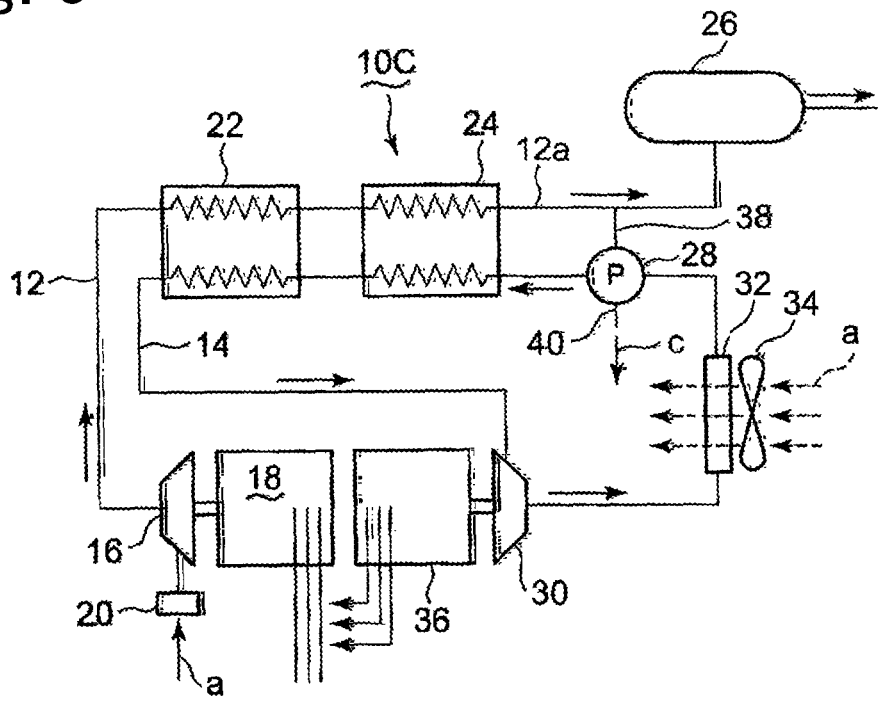
FIG. 3 is a system diagram of a waste heat utilization device according to a third embodiment of the device of the present invention.

Further, when an oil type air compressor is used, the branch passage 38 may be provided on the discharge path 12*a* on the downstream side of the preheater 24, and the branch passage 38 may be connected to the circulation pump 28, as in the third embodiment (FIG. 3). In this example, the circulation pump 28 is driven by a part of the compressed air, and after driving the circulation pump 28, the compressed air c is discharged through the discharge passage 40. Since the circulation pump 28 can be driven using a part of the compressed air, power for driving the circulation pump 28 is not required.

Figure 4:
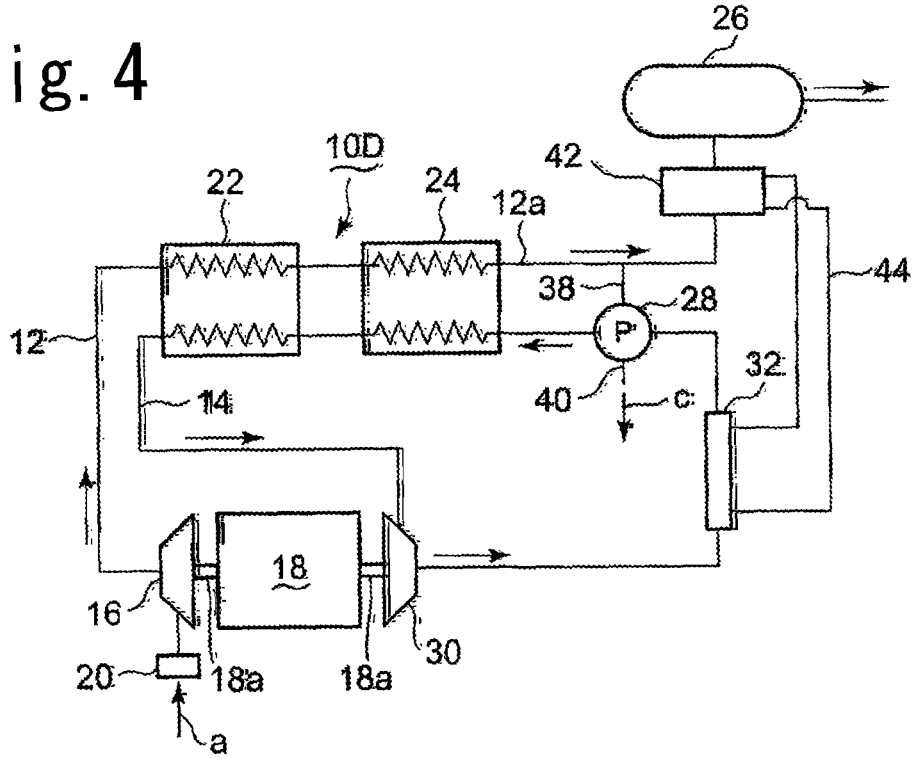
FIG. 4 is a system diagram of a waste heat utilization device according to a fourth embodiment of the device of the present invention.

Furthermore, when an oil type air compressor is used, the refrigeration type dryer 42 may be provided on the discharge path 12*a* on the downstream side of the preheater 24 and the upstream side of the air receiver 26, and the cooling medium cooled by the refrigeration type dryer 42 may be introduced into the condenser 32 to cool the low boiling point medium, as in the fourth embodiment (FIG. 4). As a result, the cooling effect on the low boiling point medium in the condenser 32 can be improved.

Moreover, when an oil type air compressor is used, the condenser 32, the heat exchanger 46, and the fan 34 may be arranged in parallel in addition to the refrigeration type dryer 42, as in the modified example (FIG. 5) of the fourth embodiment. In so doing, the heat exchanger 46 cools the outside air a using the cooling medium transmitted from the refrigeration type dryer 42, and the low boiling point medium flowing through the condenser 32 is cooled by the cooled outside air a. As a result, the cooling effect on the low boiling point medium can be improved.

Figure 6:
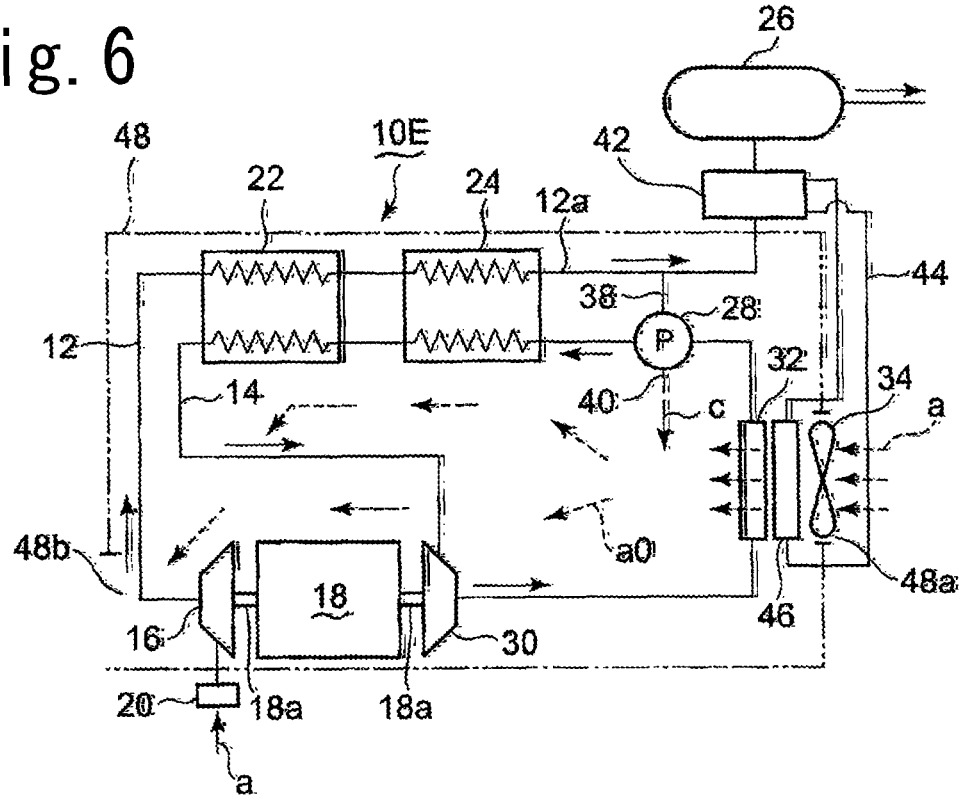
FIG. 6 is a system diagram of a waste heat utilization device according to a fifth embodiment of the device of the present invention.

Furthermore, when an oil type air compressor is used, the respective constituent devices, including the oil type air compressor, may be housed in the interior of the single housing 48, the outside air introduction port 48*a* may be provided in the housing side wall near the condenser 32, and the outside air discharge port 48*b* may be provided on the opposite side to the outside air introduction port 48*a* in the side wall near the oil type air compressor, as in the fifth embodiment (FIG. 6). In so doing, the outside air a is introduced through the outside air introduction port 48*a* by the fan 34 provided to face the outside air introduction port 48*a*, whereby the outside air flow a0 is formed in the interior of the housing 48. The low boiling point medium in the condenser 32 is cooled by the outside air flow a0, and the outside air flow a0 is also used to ventilate the interior of the housing 48 and cool the respective constituent devices including the oil type air compressor. As a result, a specialized cooling device need not be provided separately.

Moreover, when an oil type air compressor is used, the respective configurations of the first to fifth embodiments may be combined as desired. In so doing, actions and effects obtained in the respective embodiments can be obtained synergistically.

According to the present invention, potential heat of compressed air discharged from an air compressor can be recovered efficiently, and recovered thermal energy can be used to reduce the power consumption of the air compressor.

What is claimed is:

1. A waste heat utilization device for an air compressor, comprising:

an air compressor;

a discharge path of the air compressor;

a circulation path along which a low boiling point medium circulates;

an evaporator interposed on the discharge path and the circulation path to evaporate the low boiling point medium by performing heat exchange between the low boiling point medium and at least one of compressed air discharged from the air compressor or lubricating oil included in the compressed air;

an expansion machine into which the low boiling point medium evaporated by the evaporator is introduced such that a rotary force is applied thereto by the low boiling point medium; and a condenser that cools and condenses the low boiling point medium discharged from the expansion machine, a circulation pump interposed on the circulation path to circulate the low boiling point medium;

and a branch passage that bifurcates from the discharge path and is connected to the circulation pump, wherein:

a power consumption of the air compressor is reduced by the rotary force generated in the expansion machine, and the compressed air is introduced into the circulation pump from the branch passage such that the circulation pump is driven by the compressed air.

2. The waste heat utilization device for an air compressor according to claim 1, further comprising a preheater that is interposed on the discharge path and the circulation path in order to preheat the low boiling point medium prior to being subjected to the heat exchange in the evaporator, using the compressed air following the heat exchange in the evaporator or the lubricating oil included in the compressed air.

3. The waste heat utilization device for an air compressor according to claim 1, further comprising:

an aftercooler interposed on the discharge path on a downstream side of the evaporator or the preheater; and a cooling medium introduction passage that introduces a cooling medium from the aftercooler into the condenser, wherein the condenser is constituted by a heat exchanger that cools the low boiling point medium using the cooling medium.

4. The waste heat utilization device for an air compressor according to claim 1, wherein the air compressor, evaporator, expansion machine, and condenser are housed in a single housing, and the housing is provided with an outside air introduction port and an outside air discharge port, the condenser comprises an outside air flow forming device and a heat exchanger that cools the low boiling point medium using an outside air flow, and outside air is introduced through the outside air introduction port by the outside air flow forming device, whereby the outside air flow forming device forms an outside air flow that passes through the heat exchanger inside the housing and is then discharged through the outside air discharge port.

5. The waste heat utilization device for an air compressor according to claim 1, wherein the air compressor is an oil free air compressor, and the low boiling point medium is evaporated in the evaporator through heat exchange with the compressed air discharged from the oil free air compressor.

6. The waste heat utilization device for an air compressor according to claim 1, wherein a power generator is connected to the expansion machine via a rotary shaft, and the power generator is driven to generate power by the rotary force of the expansion machine.

7. The waste heat utilization device for an air compressor according to claim 1, wherein a rotary shaft of the expansion machine is connected to an output shaft of a motor that drives the air compressor, and a rotary torque of the air compressor is reduced by rotation of the expansion machine.

* * * * *